US009175676B2

(12) United States Patent
Fortin et al.

(10) Patent No.: US 9,175,676 B2
(45) Date of Patent: Nov. 3, 2015

(54) FLUID COMPRESSION SYSTEM

(75) Inventors: Regis Fortin, Laval (CA); Andre Emond, Montreal-Nord (CA); Michel Bisson, Blainville (CA)

(73) Assignee: LES CHAUSSURES STC INC. (CA)

( * ) Notice: Subject to any disclaimer, the term of this patent is extended or adjusted under 35 U.S.C. 154(b) by 730 days.

(21) Appl. No.: 13/060,878

(22) PCT Filed: Nov. 29, 2010

(86) PCT No.: PCT/CA2010/001910

§ 371 (c)(1),
(2), (4) Date: May 11, 2012

(87) PCT Pub. No.: WO2011/069241

PCT Pub. Date: Jun. 16, 2011

(65) Prior Publication Data

US 2012/0233989 A1 Sep. 20, 2012

Related U.S. Application Data

(60) Provisional application No. 61/267,621, filed on Dec. 8, 2009.

(51) Int. Cl.

| | |
|---|---|
| ***F01B 7/20*** | (2006.01) |
| ***F04B 25/02*** | (2006.01) |
| ***A43B 13/20*** | (2006.01) |
| ***F04B 9/14*** | (2006.01) |

(52) U.S. Cl.

CPC ..... *F04B 25/02* (2013.01); *A43B 13/203* (2013.01); *F04B 9/14* (2013.01)

(58) Field of Classification Search

CPC ..... F04B 9/14; F04B 25/02; F04B 43/067; A43B 7/04; A43B 7/105; A43B 13/203; A43B 17/035; A43B 21/285

USPC ..... 92/6 R

See application file for complete search history.

(56) References Cited

U.S. PATENT DOCUMENTS

| | | | | |
|---|---|---|---|---|
| 1,263,401 | A | | 4/1918 | Frasier |
| 3,775,027 | A | * | 11/1973 | Craft ..... 417/214 |
| 4,823,482 | A | * | 4/1989 | Lakic ..... 36/2.6 |
| 5,542,827 | A | | 8/1996 | Dombek et al. |

(Continued)

FOREIGN PATENT DOCUMENTS

GB 2341898 A 3/2000

OTHER PUBLICATIONS

International Search Report PCT/CA2010/001910; Dated Feb. 25, 2011.

*Primary Examiner* — Michael Leslie
(74) *Attorney, Agent, or Firm* — Cantor Colburn LLP

(57) ABSTRACT

A fluid pump (10) has a compression member (12) having a variably-sized compression surface (**13*b*) movable against fluid pressure in a chamber (22). The effective surface area of the compression member (12) decreases in size together with a corresponding cross-sectional area of the chamber (22) from a maximal area at a beginning of the compression stroke to a minimal area at the end of the compression stroke. Using a variably-sized surface area to compress a fluid volume allows obtaining a rapid gain of fluid pressure even for applications in which the compression member (12**) is actuated at relatively low frequencies and under the action of relatively small forces.

12 Claims, 13 Drawing Sheets

(56) References Cited

U.S. PATENT DOCUMENTS 6,239,501 B1 5/2001 Komarechka
6,978,711 B1 * 12/2005 Van der Blom ..... 92/6 R
2008/0127510 A1 6/2008 Yang
2008/0181800 A1 7/2008 Muschalek

* cited by examiner

FLUID COMPRESSION SYSTEM

TECHNICAL FIELD

The technical field relates generally to converting mechanical energy to fluid energy, and more particularly to fluid compression systems and fluid pumps.

BACKGROUND OF THE ART

Different energy conversion systems exist for converting mechanical energy to fluid energy, i.e. fluid pressure. One such system is a fluid compression system, such as a pump, whereby a force is applied on an enclosed fluid, thereby raising the pressure of the fluid. An example of this type of pump is a common bicycle pump, such as used to inflate tires. Another example is a piston and cylinder system, whereby mechanical work is done by the piston on the fluid inside the cylinder, thereby compressing or raising the pressure of this fluid. This system is commonly used in internal combustion engines.

However, many difficulties arise in these types of fluid compression systems. For instance, it has always been challenging to rapidly raise the fluid pressure in systems having pistons actuated at relatively low frequencies (e.g. less than about 5 Hz) with relatively small constant forces (e.g. 25 lb). One of the difficulties that exist with the piston and cylinder system is that the cylinder is often quite long and requires the piston to travel a relatively long distance in order to achieve high compression ratios. The length of the cylinder therefore requires that the system be of a certain size which may not be practical in all applicable situations. Furthermore, because of the length of the cylinder, the piston may require a sizable amount of time before the piston reaches the end of its cycle. In the case of pumps, such as a bicycle tire pump, the pump often requires a user to exert minimal force for a short period of time, until the pressure builds in the tire, in which case the pump requires a substantial amount of force from a user to further pressurize the tire. Bicycle pumps may also require a large stroke length, as in piston and cylinder systems.

Therefore, there yet exists room for improvement in terms of efficiently converting mechanical energy to fluid energy, i.e. fluid pressure, such as in fluid compression systems.

SUMMARY

In accordance with one aspect, there is provided a fluid compression system for pressurizing a fluid, the fluid compression system comprising a compression surface having a variably-sized surface area, a housing, the housing and the compressor surface enclosing a fluid volume therebetween, the compression surface being movable over a length of the housing, the fluid volume being compressed as the compression surface is moved towards an end of the housing, the surface area of the compression surface being at least two different sizes as the compression surface is moved in the housing, the compression surface having a smaller surface area and pumping a smaller volume of fluid towards the end of the compression stroke.

In accordance with a second aspect, there is provided a fluid pump comprising a chamber containing a fluid, the chamber having a fluid inlet and a fluid outlet, a compression member having a compression surface with an effective surface area movable against fluid pressure in the chamber, the compression member having a compression stroke and a return stroke, the effective surface area of the compression member decreasing in size together with a corresponding cross-sectional area of the chamber from a maximal area at a beginning of the compression stroke to a minimal area at the end of the compression stroke.

In accordance with a third aspect, there is provided a method for imparting pressure to a fluid by direct displacement of a compression member in a chamber containing a fluid, the chamber having a fluid inlet and a fluid outlet, the compression member having a compression surface on which the fluid in the chamber exerts a pressure, the compression surface of the compression member having a variable effective surface area, the method comprising: reducing the effective surface area of the compression member and a corresponding cross-sectional area of the chamber along a compression stroke of the compression member in the chamber, the effective surface area of the compression member and the cross-sectional area of the chamber being smaller towards the end of the compression stroke than at a beginning of the compression stroke.

In accordance with a further aspect, there is provided a fluid compression system comprising a piston mounted for reciprocable movement in a pressure chamber adapted to contain a fluid, the piston having a compression stroke and a return stroke, wherein an effective area of the piston on which the fluid exert a pressure on the compression stroke decreases from a maximal effective area at a beginning of the compression stroke to a minimal effective area at the end of the compression stroke.

In accordance with another further aspect, there is provided a fluid compression system comprising a pressure chamber and a piston mounted for reciprocable movement in the pressure chamber, the pressure chamber and the piston having a variable effective area for pressuring the fluid, the variable effective area becoming smaller as the piston proceed towards the end of its compression stoke.

In accordance with a still further aspect, there is provided a non-linear gas pump comprising at least three concentric pistons disposed radially one inside the other, a hollow intermediately-sized piston circumscribing in abutment an inner radial piston and a hollow outer radial piston circumscribing in abutment the intermediately-sized piston, securing means on the pistons such that the three concentric pistons remain integral, a force-conveying member being in contact with the inner radial piston, a housing having at least three cylinders consecutively longitudinally spaced one from the other, with a first cylinder of a volume substantially similar to that of the outer radial piston, a second cylinder spaced longitudinally from the first cylinder and of a volume substantially similar to that of the intermediately-sized piston and a third cylinder spaced longitudinally from the second cylinder and of a volume substantially similar to that of the inner radial piston, the third cylinder being connected to a conduit for allowing fluid passage therethrough, the volume of the three cylinders defining a fluid volume of the housing, the first cylinder receiving the three pistons until the outer radial piston abuts an end wall of the first cylinder and the securing means releases the intermediately-sized piston from the outer radial piston, the second cylinder receiving the intermediately-sized piston and the inner radial piston until the intermediately-sized piston abuts an end wall of the second cylinder and the securing means releases the inner radial piston from the intermediately-sized piston, and the third cylinder receiving the inner radial piston, wherein the fluid volume is compressed by the displacement of the pistons in the cylinders, the fluid volume passing through the conduit as the inner radial piston is received in the third cylinder.

In accordance with a still further aspect, there is provided a device for recovering and converting mechanical energy into fluid energy comprising a force transmitting member adapted to be connected to a source of mechanical energy, a piston connected to the force transmitting member and movable thereby, the piston being mounted for movement in a pressure chamber containing a fluid, the piston and the pressure chamber having an effective area on which the fluid exert a pressure, the effective area of the piston and the chamber varying along a movement axis of the piston in the chamber, the effective area becoming smaller as the piston travels towards an end of a compression stroke thereof, thereby proving for the pumping of a smaller volume of fluid at the end of the compression stroke than at a beginning thereof, and a tank connected in fluid flow communication with the pressure chamber for receiving the fluid compressed by the piston.

DETAILED DESCRIPTION

Now referring more particularly to the drawings, there will be described a reciprocable fluid compression system involving a compression surface which is pressed against a fluid. As will be seen hereinbelow, the compression surface compresses a fluid volume using a variably-sized surface area in order to obtain a rapid gain of fluid pressure even for applications in which the piston is actuated at relatively low frequencies and under the action of relatively small forces. For instance, the compression surface, using a first surface area A1, will compress a fluid volume. Following this first compression stage, the compression surface, using a surface area A2, will then further compress the fluid volume. The surfaces areas A1 and A2 may not be equal, i.e. may be different. In other words, the compression surface has a variable surface area, wherein the surface area of the compression surface may change as the fluid is being compressed.

Figure 1:
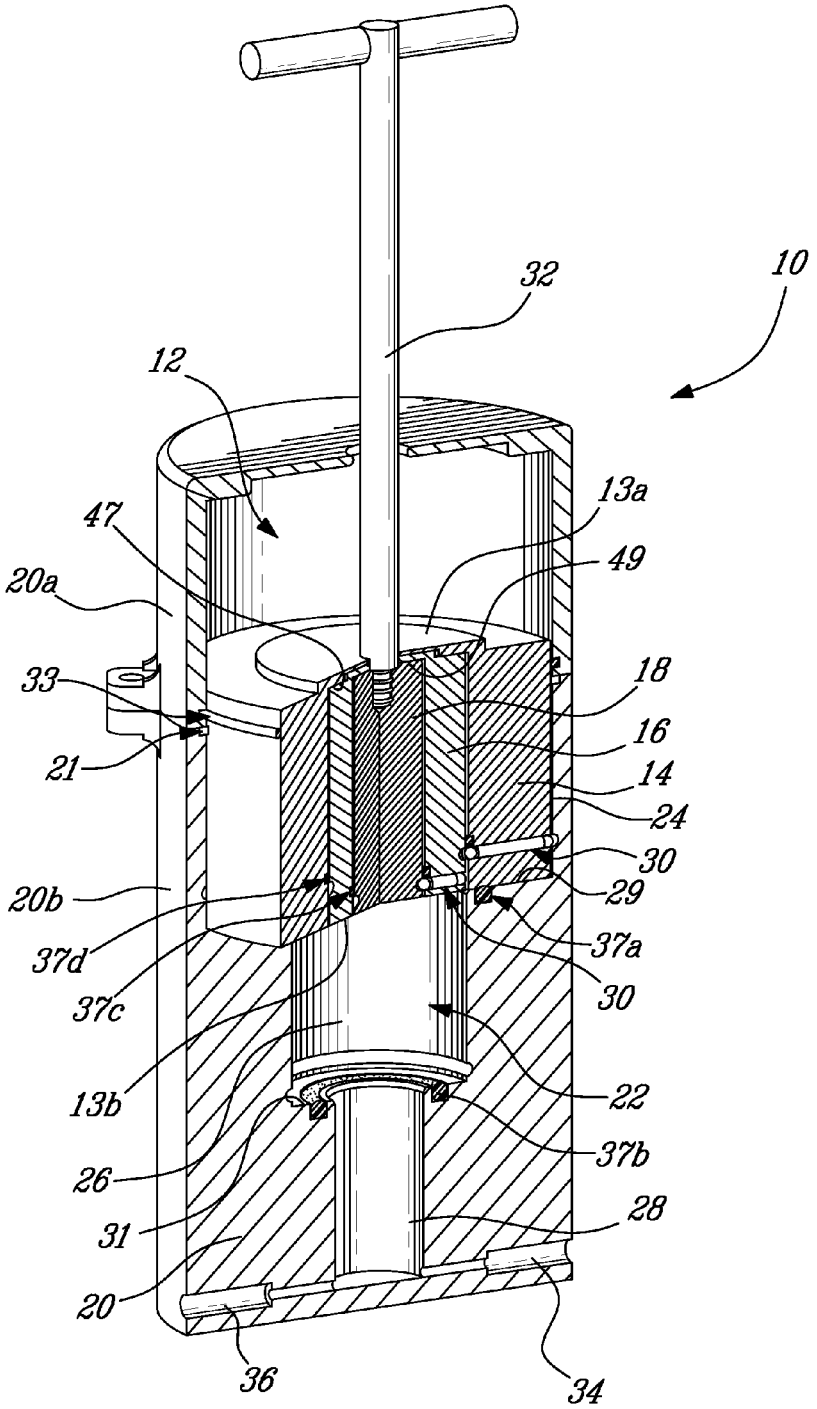
FIG. 1 is a perspective view of a cross-section of one particular embodiment of a fluid compression system including detachable piston sections.

As seen in the embodiment shown in FIG. 1, the fluid compression system 10 may generally comprise a compression member, such as a piston 12, mounted for movement in a housing 20 defining a pressure chamber 22, and a force-conveying member 32 for transmitting a driving force to the piston 12. The housing 20 includes a cover 20*a* which may be bolted or otherwise secured to a base 20*b*. A gasket 21 is provided at the joint between the base 20*b* and the cover 20*a*. The force-conveying member 32 extends axially through the cover 20*a* from a piston-rod surface 13*a* of the piston 12 (the top surface of the piston in FIG. 1) opposite to an effective fluid compression surface 13*b* thereof (the bottom surface of the piston in FIG. 1). The fluid compression surface 13*b* of the piston 12 and the housing chamber 22 defines a variable fluid volume. As will be seen hereinafter, the effective area of the piston compression surface 13*b* on which the fluid exerts a pressure varies during the compression stroke of the piston 12.

The housing chamber 22 comprises a plurality (three in the illustrated embodiment) of axially serially interconnected chamber portions, which may include a large chamber portion 24, an intermediate chamber portion 26 and a small chamber portion 28. The large chamber portion 24 is firstly positioned inside the housing chamber 22, followed by the intermediate chamber portion 26 which begins and extends past where the large chamber portion 24 ends, which itself is followed by the small chamber portion 28 which begins and extends past where the intermediate chamber portion 26 ends. In FIG. 1, the piston 12 is located inside the large chamber portion 24. A first annular shoulder 29 is defined at the interface between the large chamber portion 24 and the intermediate chamber portion 26. A second annular shoulder 31 is defined at the interface between the intermediate chamber portion 26 and the small chamber portion 28.

As seen in FIG. 1, the piston 12 comprises a corresponding number (three in the illustrated example) of releasably interconnected concentric piston portions, including an outer annular hollow piston portion 14 which circumscribes an intermediate annular hollow piston portion 16 which itself circumscribes an inner piston portion 18. These piston portions 14, 16 and 18 are releasably integral (i.e. detachably interconnected) through the use of attachment means 30 located therebetween. When the three piston portions 14, 16, 18 are integral, as is shown in FIG. 1, the compression surface 13*b* is defined by the surface areas of the bottom surfaces of the three piston portions 14, 16, 18. The outer piston portion 14 is substantially sized so as to fit in the large chamber portion 24 and for sealing engagement with an O-ring 33 mounted in a circumferential groove defined in the inner surface of the large chamber portion 24. The intermediate piston portion 16 is substantially sized so as to tightly fit in the intermediate chamber portion 26 and the inner piston portion 18 is substantially sized so as to tightly fit in the small chamber portion 28. The force-conveying member 32 is connected, such as by threads, to the inner piston portion 18, and is used to transmit a force directly to the inner piston portion 18. As will be seen hereinafter, the force is then transmitted from inner piston portion 18 to the intermediate piston portion 16 and the outer piston portion 14 via the attachment means 30 until the piston portions separate from one another.

Although in the embodiment shown, the piston 12 comprises three piston portions, in another embodiment, the piston may comprise any number of a plurality of piston portions, for example, 2, 3, 4 or more piston portions. In addition, in another embodiment, the force-conveying member 32 may be attached to an underside portion of inner piston portion 18, so as to pull on inner piston portion 18, as opposed to applying a downwards force on it.

Near the bottom of the small chamber portion 28 is a fluid intake 36 and a compressed fluid exhaust 34. Once the fluid compression system 10 has compressed the fluid volume defined by the housing chamber 22, the fluid will exhaust from the housing chamber 22 through the exhaust 34. Once the compressed fluid has been exhausted from the housing chamber 22, fresh fluid will be admitted to the housing chamber 22 through the fluid intake 36. As shown in FIGS. 2*a* to 2*d*, one-way valves 39 and 41 are respectively provided at the fluid exhaust 34 and at the fluid intake 36 to prevent reverse fluid flow therethrough. The valves 39 and 40 are set to open at the predetermined pressures. The fluid compression system 10 additionally comprises o-rings 37*a* and 37*b*, which are mounted on shoulders 29 and 31 to minimize any fluid escaping from the intermediate chamber portion 26 to the large chamber portion 24 and from the small chamber portion 28 to the intermediate chamber portion 26, respectively. Additional o-rings 37*c* and 37*d* are respectively mounted on the radially inner surface of the intermediate piston portion 16 and the radially inner surface of the outer piston portion 14 to respectively prevent fluid leakage between the intermediate piston portion 16 and the inner piston portion 18 and between the outer piston portion 14 and the intermediate piston portion 16. It should be noted that in another embodiment, the piston portions 14, 16, 18 and the housing chamber portions 24, 26, 28 may be of a different shape, i.e. be elliptical, rectangular, triangular, etc.

Figure 2A:
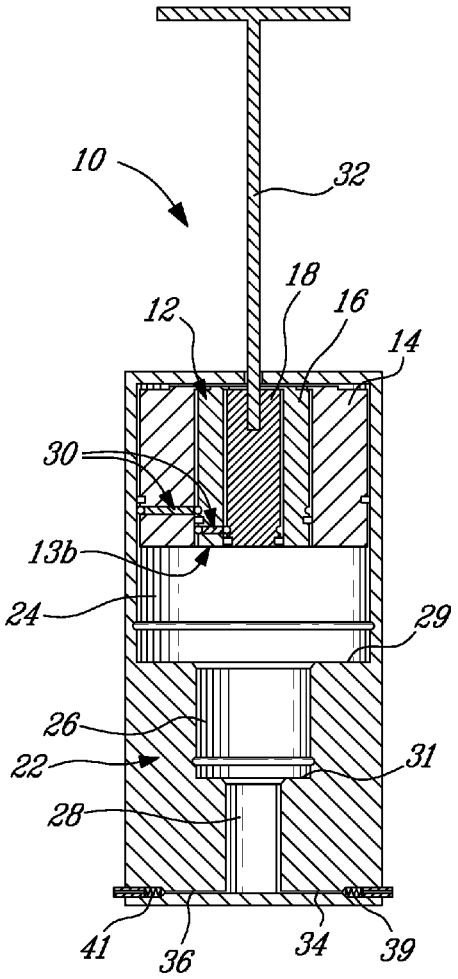
FIGS. 2*a*, 2*b*, 2*c* and 2*d* are cross-sectional sequential schematic views illustrating four positions in the compression stroke of one embodiment of the fluid compression system.

Using FIGS. 2*a*, 2*b*, 2*c* and 2*d*, the compression stroke of the fluid compression system 10 will be explained in greater detail. In the first position (i.e. before initiating the compression stroke), as shown in FIG. 2*a*, the three piston portions 14, 16, 18 of the piston 12 are interconnected by the attachment means 30 for joint movement as an integral piston structure and are located at the upper end of the large chamber portion 24 of the housing chamber 22.

Figure 2B:
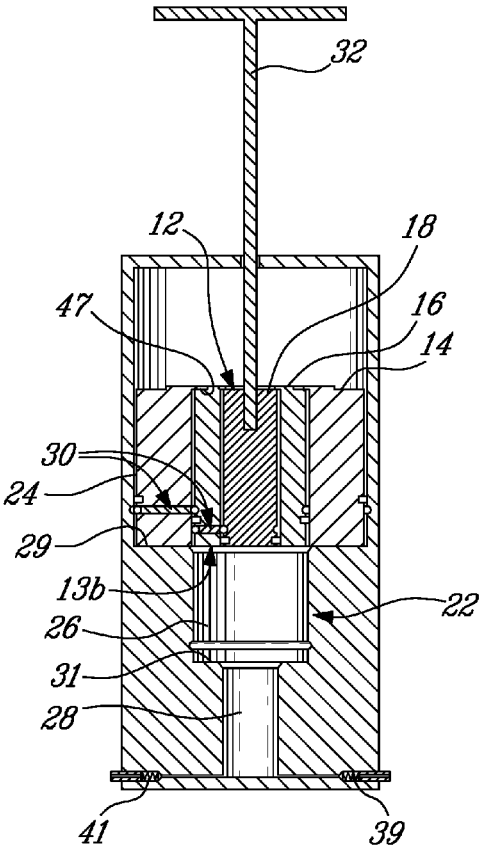
Figure 2C:
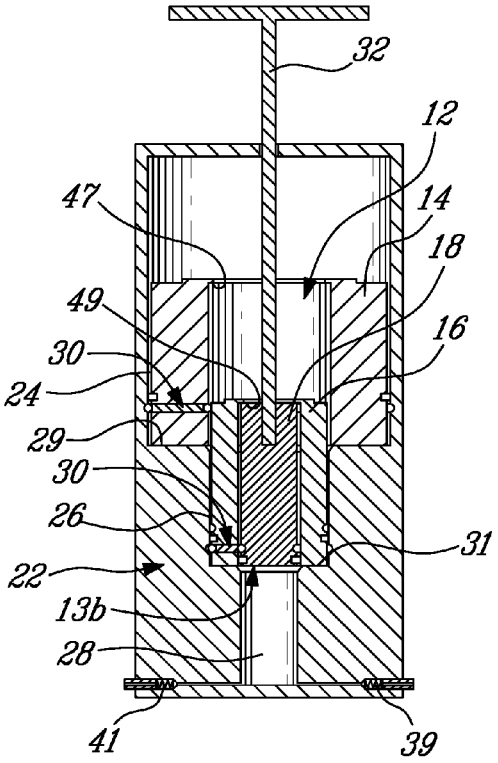
Figure 2D:
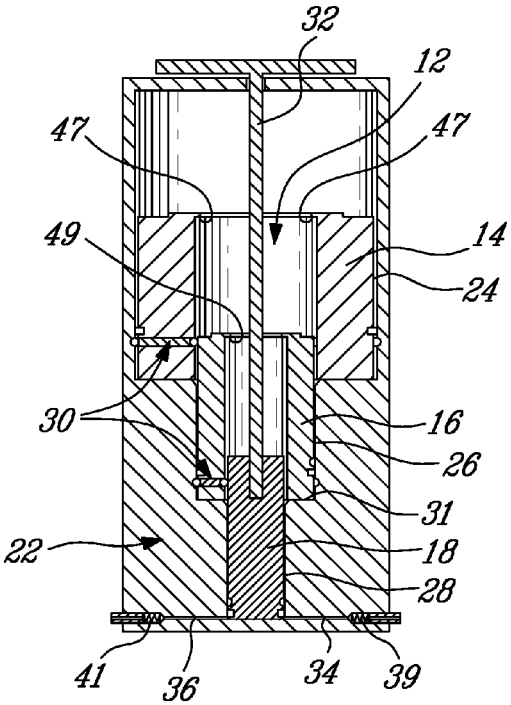

The force transmitted to the inner piston portion 18 by the force conveying-member 32, then causes the three interconnected piston portions 14, 16 and 18 to move jointly to a second position illustrated in FIG. 2*b*. In the second position, the three piston portions of the piston 12 have entered the housing chamber 22 and are located at the bottom end of the large chamber portion 24 with the outer piston portion 14 resting axially against annular shoulder 29. In this position, the piston 12 has compressed the fluid volume by an amount equal to the size of the large chamber portion 24, using a compression surface 13*b* equal to the bottom surface areas of the three piston portions 14, 16, 18.

The engagement of the outer piston portion 14 with the shoulder 29 prevents the outer piston portion 14 from moving further into the housing chamber 22. From the second position illustrated in FIG. 2*b*, the continued pushing action of the force-conveying member 32 on the inner piston portion 18 automatically causes the attachment means 30 to release the outer piston portion 14 from the intermediate piston portion 16, thereby allowing the inner and intermediate piston portions 16 and 18 to continue their stroke to the third position illustrated in FIG. 2*c*. In the third position, the inner and intermediate piston portions 16, 18 have entered the intermediate chamber portion 26 and are located at a bottom end thereof with the intermediate piston portion axially resting against the shoulder 31. In this position, the piston 12 has further compressed the fluid volume by an amount equal to the size of the intermediate chamber portion 26, but in this step, the piston 12 has done so with a smaller compression surface 13*b* equal to the bottom surfaces of the intermediate and inner piston portions 16, 18.

The engagement of the intermediate piston portion 16 with the shoulder 31 prevents the intermediate piston portion 16 from moving further into the housing chamber 22 beyond the intermediate chamber portion 26. From the third position illustrated in FIG. 2*c*, the continued pushing action of the force-conveying member 32 on the inner piston portion 18 automatically causes the attachment means 30 to release the intermediate piston portion 16 from the inner piston portion 18, thereby allowing the inner piston portion 18 to continue its stroke to the fourth position illustrated in FIG. 2*d*. In the fourth position, the inner piston portion 18 has entered and is located at or substantially near the bottom end of the small chamber portion 28. In this position, the piston 12 has further compressed the fluid volume by an amount substantially equal to the size of the small chamber portion 28, but in this step, the compression is done with a compression surface 13*b* equal to the bottom surface of the inner piston portion 18. The compressed fluid volume is then exhausted through the exhaust 34 where it can be stocked in a tank before being used in a given application. The one-way valve prevents the compressed fluid from flowing back into chamber 22 during the return stoke of the piston 12.

Figure 4:
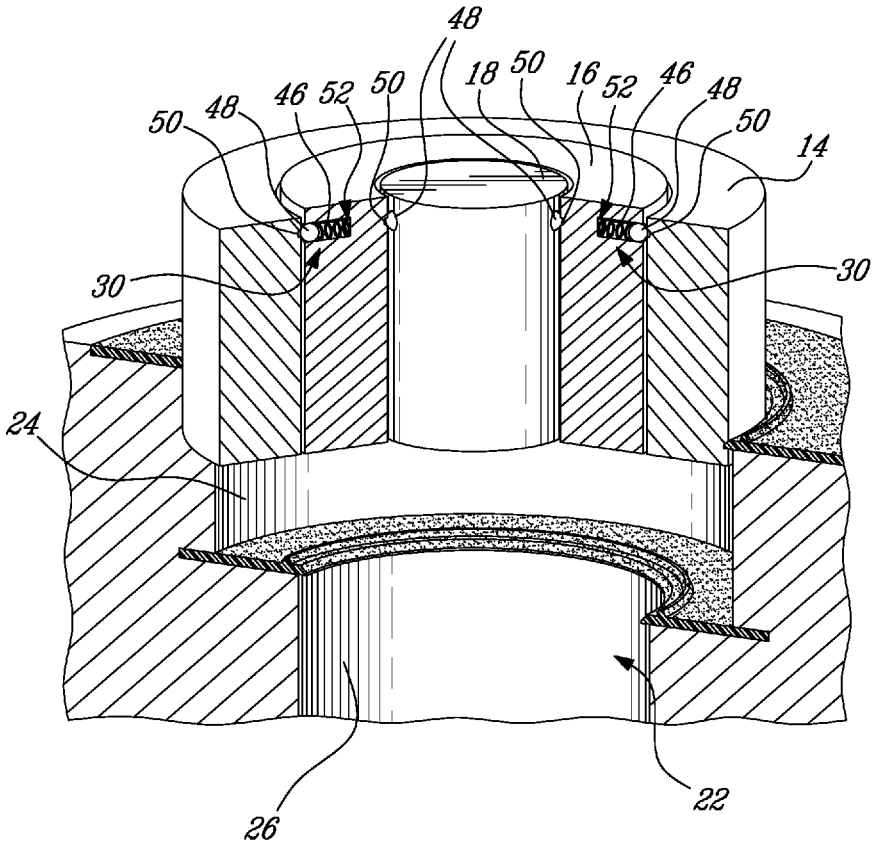
FIG. 4 shows an alternative embodiment of a locking system that can be used to detachably interconnect the piston sections of the fluid compression system.

It is to be noted that the compressed fluid volume may begin to be exhausted through the exhaust 34, prior to the inner piston portion reaching the end of the small chamber portion 28. Once the compressed fluid volume has been exhausted, the intake 36 may begin to admit fresh fluid into the housing chamber 22 and the piston portions 14, 16, 18 may be returned to the initial position, as seen in FIG. 1, where the piston portions 14, 16, 18 are integral one with another. The fluid compression system 10 is therefore reciprocable. The fluid compression system 10 comprises a return stroke, whereby the piston portions 14, 16, 18 may, from the position shown in FIG. 4, return to the initial position, as seen in FIG. 1. This return stroke may be caused by a biasing member (not shown), such as a spring, which is attached to the force conveying member 32, and which causes the force conveying member to return to the initial position as seen in FIG. 1, when the fluid volume has been compressed and exhausted through the compressed fluid exhaust 34, as seen in FIG. 4. When the force conveying member 32 returns to its initial position, the piston portions 14, 16, 18 also return to their initial position, as seen in FIG. 1, where they are once again maintained integral by the attachment means 30. As the force conveying member 32 is biased upwards, the piston portions 14 and 16 may reconnect with the inner piston portion 18 due to the inner piston portion 18 which abuts and so raises inner shoulders 47 and 49, which are respectively provided on the outer and intermediate piston portions 14 and 16. The inner shoulders 47 and 49 respectively provide arresting surfaces for the inner and intermediate piston portions 18 and 16 during the return stroke of the piston 12. The piston portions 14, 16, 18 may also be returned to the initial position by the action of the fluid which is admitted into the housing chamber 22 through the fluid intake 36. When the compressed fluid volume has been exhausted from the housing chamber 22, as seen in FIG. 4, the fluid which enters through the fluid intake 36 may also serve to raise the piston portions 14, 16, 18.

The fluid compression system 10, as shown in the embodiment of FIGS. 2*a*, 2*b*, 2*c* and 2*d*, presents many advantages. By using a compression surface having a surface area which varies over the compression cycle, the fluid compression system may attain high compression ratios, in a short span of time or in a short length of displacement of the piston, as compared to typical piston and cylinder systems, where the cylinder has only one diameter throughout its length and is relatively long. In the embodiment shown, the chamber initially has a diameter defined by the large chamber portion 24 and subsequently, has smaller diameters as exemplified by the diameters of the intermediate and small chamber portions 26, 28 respectively. When the compression cycle begins, the fluid volume inside the housing chamber is at a relatively low pressure, and the pressure of the fluid volume may quickly rise as the fluid volume is compressed by a large compression surface area, i.e. the surface areas of all three piston portions 14, 16, 18. As the compression cycle continues, the pressure of the fluid volume inside the housing chamber will be greater, and in order to maintain a sustained rate of compression, the fluid volume may be compressed with a smaller compression surface area, i.e. the surface areas of the intermediate and inner piston portions 16, 18 and then afterwards, with only the surface area of the inner piston portion 18. Because of the relationship between pressure and area and due to the compression surface having a variable surface area, the fluid compression system may be used to obtain higher compression ratios than in typical piston and cylinder systems. In addition, it is possible to optimize the fluid compression system by modifying the surface areas of each individual piston portion 14, 16, 18 and also by varying the length of each of the housing chambers 14, 16, 28. This allows the fluid compression system to be customized according to the particular load, i.e. frequency and force, which will be applied to the force-conveying member 32 or according to a desired result, i.e. fluid volume pressure desired or pressurized fluid flow rate desired.

Furthermore, as seen in FIG. 1, the force-conveying member 32 is only connected to the inner piston portion 18, so a force is only directly transmitted to inner piston portion 18. As the compression surface 13 becomes smaller, no force is applied to the larger piston portions, as only the smaller piston portions are actually compressing the fluid volume. For example, once the outer piston portion 14 has reached the bottom end of the large chamber portion 24, a force is no longer indirectly transmitted to the outer piston portion 14, the force is solely applied to the inner piston portion 18, and because the inner piston portion 18 is held integral with intermediate piston portion 16, the intermediate and inner piston portions 16, 18 translate through intermediate chamber portion 26. The intermediate and inner piston portions 16, 18 thereby compress the fluid volume located inside the housing chamber 22 using the compression surface 13, defined by the bottom surface areas of said piston portions 16, 18. No force is thereby wasted by being transmitted to piston portions which are not currently compressing the fluid volume. This means that whatever force is applied on the inner piston portion 18 will always serve to pressure the compression surface 13 into compressing the fluid volume, regardless of the housing chamber portion in which the piston portions are currently compressing the fluid volume. In one embodiment, a constant force is applied on the inner piston portion 18, through the force-conveying member 32. It is to be noted that in another embodiment, a force may be applied independently to all three piston portions 14, 16, 18 or simultaneously to all three. In other embodiments, the force-conveying member 32 may be of a different shape than that shown in FIG. 1 and should not be limited in scope to this particular form.

The fluid compression system 10 may also comprise a compressed fluid accumulation tank (not shown) which is located at the end of the compressed fluid exhaust 34. The accumulation tank serves to retain or hold the compressed fluid volume which is exhausted from the housing chamber 22 and is directed to the accumulation tank through the compressed fluid exhaust 34. The valve 39 permits and controls passage of the compressed fluid volume through the compressed fluid exhaust 34 and into the accumulation tank. In one embodiment, the valve is a one-way valve or check valve. In another embodiment, the valve may be another type of valve, such as a pressure regulated valve. In one embodiment, the valve only allows the compressed fluid volume to pass through the compressed fluid exhaust 34 and so into the accumulation tank, when the pressure of the compressed fluid volume located inside the housing chamber 22 is greater than the pressure of the fluid located inside the accumulation tank.

Figure 3:
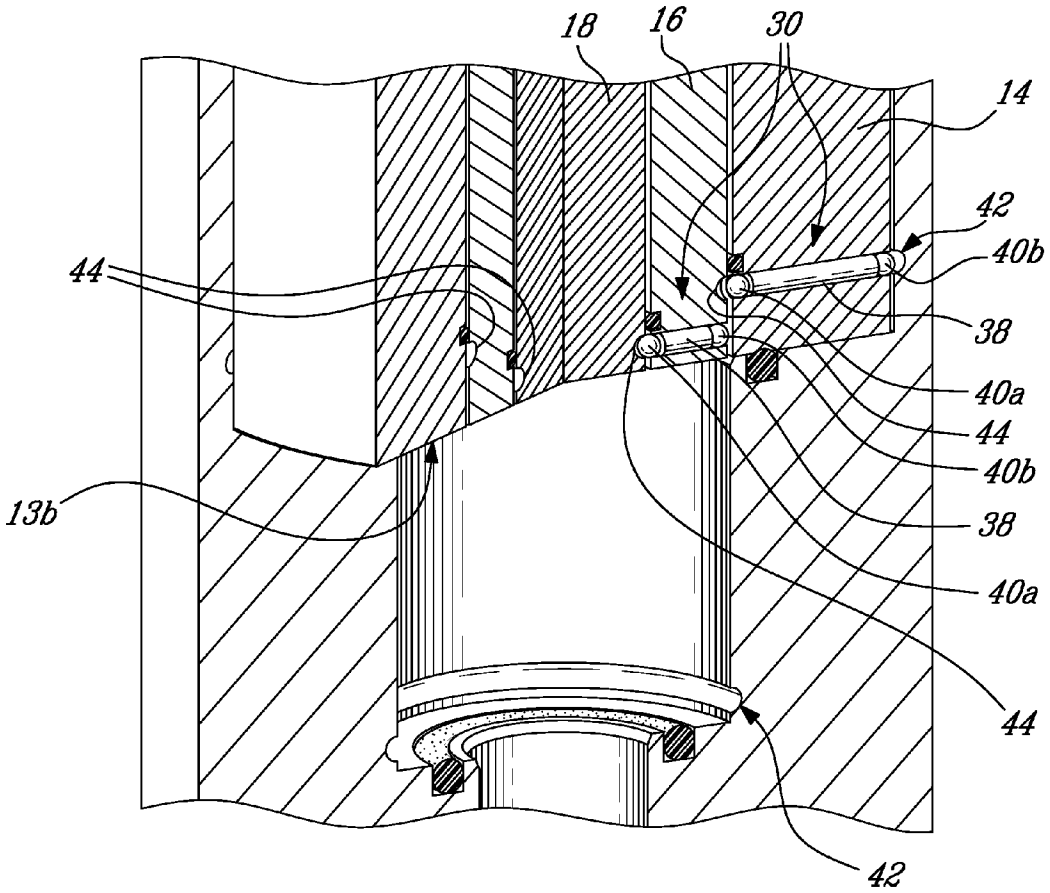
FIG. 3 is an enlarged view of the fluid compression system shown in FIG. 1 illustrating the details of the attachment means used to detachably interconnect the piston sections of the fluid compression system

The piston portions 14, 16, 18 are held releasably integral through the use of a releasable connecting/locking mechanism or attachment means 30 located therebetween. Different connector or attachment means 30 may be used to maintain the piston portions 14, 16, 18 releasably integral. The type of attachment means 30 shown in the embodiment of FIG. 1 is shown in greater detail in FIG. 3. The attachment means 30 may comprise at least two of locking pins 38 which are located inside the outer and intermediate piston portions 14, 16, respectively, and which extend radially, from an inner radial end to an outer radial end therein. The outer and intermediate piston portions 14, 16 each have at least one locking pin 38 located therein. In a preferred embodiment, the outer and intermediate piston portions 14, 16 each have three locking pins 38 located therein, which are spaced equally apart circumferentially. Inner balls **40*a* are located at the inner radial ends of the locking pins 38 and outer balls 40*b* are located at the outer radial ends of the locking pins 38. The intermediate and inner piston portions 16, 18 each have a circumferential groove 44 located on an outer radial portion thereof, in proximity to the compression surface 13. As seen in FIG. 3, when the intermediate and inner piston portions 16, 18 are integral, the inner balls 40*a* at the inner radial end of the intermediate piston portion 16 are located in a portion of the circumferential groove 44 located on the outer radial portion of the inner piston portion 18. When the outer and intermediate piston portions 14, 16 are integral, the inner balls 40*a* at the inner radial end of the outer piston portion 14 are located in a portion of the circumferential groove 44 located on the outer radial portion of the intermediate piston portion 16. Therefore, when a force is applied to the inner piston portion 18, the inner piston portion 18 will move integrally with the outer and intermediate piston portions 14, 16, because the balls 40 located at the inner radial ends of the locking pins 38 between the piston portions 14, 16, 18, will maintain the piston portions integral. It is to be noted that in other embodiments, where more or less piston portions are used, the fluid compression system 10** may require a relatively greater or lesser amount of locking pins.

In order to release the piston portions 14, 16, 18 from an integral position, annular grooves 42 are provided in an inner surface of the housing chamber 22 near the ends of the large and intermediate chamber portions 24, 26. When some of the piston portions are integrally moving, the outer balls **40*b* which are the most outer radially positioned are located substantially inside the respective piston portions 14, 16 and roll or slide on the inner surface of the housing chamber 22. For example, when the outer balls 40*b* located inside the outer piston portion 14 reach the annular groove 42 in the wall of the large chamber portion 24, the balls 40*b* protrude from the outer piston portion 14 into the circumferential groove 42, thereby allowing the locking pins 38 to move radially outwardly. Accordingly, the shear forces between intermediate piston portion 16 and the inner balls 40***a* will cause the inner balls 40*a* to move radially outside of the groove 44, thereby disconnecting the outer piston portion 14 from the intermediate piston portion 16 and, thus, the inner piston portion 18. The intermediate and inner piston portions 16, 18 then continue displacing into the intermediate chamber portion 26 and the inner balls 40*a* of the outer piston portion 14 will ride on the radially outer surface of the intermediate piston portion 16 outside of the groove 44 defined therein. A similar procedure occurs when the intermediate and inner piston portions 16, 18 are moving integrally in the intermediate chamber portion 26. It is to be noted that although the annular groove 42 and the circumferential groove 44 are each described as being annular and circumferential, respectively, in another embodiment, the grooves 42, 44 may simply be depressions, holes or grooves of another shape, and need not be completely circumferential.

When the piston portions 14, 16, 18 are in the return stroke (i.e. going from the position shown in FIG. 2*d* to the position shown in FIG. 2*a*), the inner piston portion 18 may reconnect with the intermediate piston portion 16 and the intermediate piston portion 16 may reconnect with the outer piston portion 14, through this same attachment means 30. As the inner piston portion 18 moves upwards in the small chamber portion 28, no balls are located inside the circumferential groove 44 therein. Once the inner piston portion 18 exits the small chamber portion 28, the inner piston portion 18 will abut the inner shoulder 49 of the intermediate piston portion 16, and so the intermediate and inner piston portions 16, 18 may move inside the intermediate chamber portion 26. As the intermediate piston portion 16 begins to move inside the intermediate chamber portion 26, the outer balls 40*b* protruding into the annular groove 42 of the wall of the intermediate chamber portion 26 will be pushed into the intermediate piston portion 16 by the wall of the chamber housing 22. The outer balls 40*b* will then press against the locking pin 38, and the locking pin 38 will press against the inner balls 40*a*, such that the inner balls 40*a* located inside the intermediate piston portion 16 will protrude into the circumferential groove 44 of the inner piston portion 18. The intermediate and inner piston portions 16, 18 will then integrally move upwards inside the intermediate chamber portion 26 during the return stroke. A similar procedure occurs with the outer piston portion 14, when the intermediate and inner piston portions 16, 18 integrally exit the intermediate chamber portion 26 and enter the large chamber portion 24.

An alternative embodiment of the attachment means 30 is disclosed in FIG. 4. In this embodiment, the attachment means 30 may comprise a circumferential groove 50 defined in an inner radial surface of the outer and intermediate piston portions 14, 16, and seats or cavities 52 defined in an outer radial surface of the intermediate and inner (not shown) piston portions 16, 18. At least one spring 46 is located in each of the cavities 52, the springs 46 are for normally biasing a ball 48 in engagement inside an associated one of the grooves 50. When the piston portions are integral, the balls 48 are biased by the spring 46 into abutment with the circumferential groove 50 of the adjacent piston portion, thereby maintaining the piston portions integral with one another. When one of the outer or intermediate portions 14, 16 reaches the end of one of the chamber portions 24, 26, the one of the outer or intermediate piston portions 14, 16 will effectively stop moving, however due to the force being transmitted from the force-conveying member 32 to the inner piston portion 18, the inner piston portion 18 will continue moving. This will create a shear-like force onto the balls 48 holding the piston portion which is in movement integral with an adjacent piston portion which has stopped moving, and the balls 48 will thereby exit circumferential groove 50 as the balls 48 follow the inner pistons 16, 18 in their movement. The balls 48 will then be pushed into the respective annular cavity 52 by an inner surface of the housing chamber 22, thereby compressing the respective spring 46. The piston portion will therefore stop moving integrally with the other piston portions, and the ball 48 will roll or slide along the inner surface of the housing chamber 22, as the piston portion in which it is located continues its movement. In other embodiments, other attachment means may be used to maintain the piston portions releasably integral, such as a releasable lock or various fasteners, such as a bolt or a clip, for example.

Figure 5B:
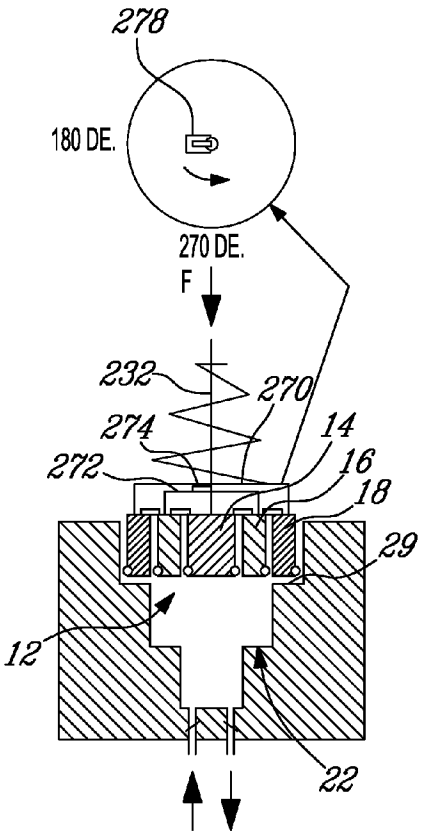
FIGS. 5*a* to 5*d* are schematic views illustrating a further alternative to the attachment means or locking system illustrated in FIGS. 3 and 4.
Figure 5A:
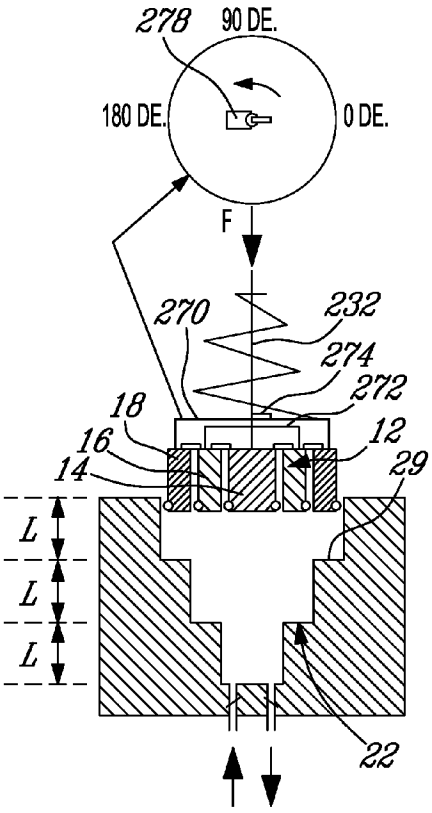
Figure 5D:
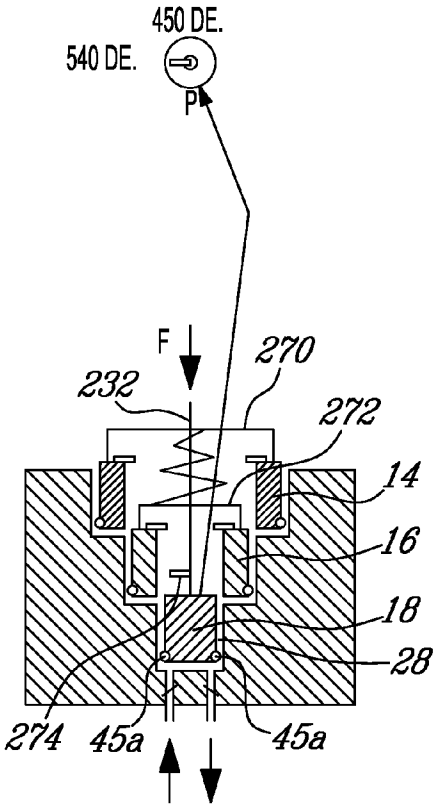
Figure 5C:
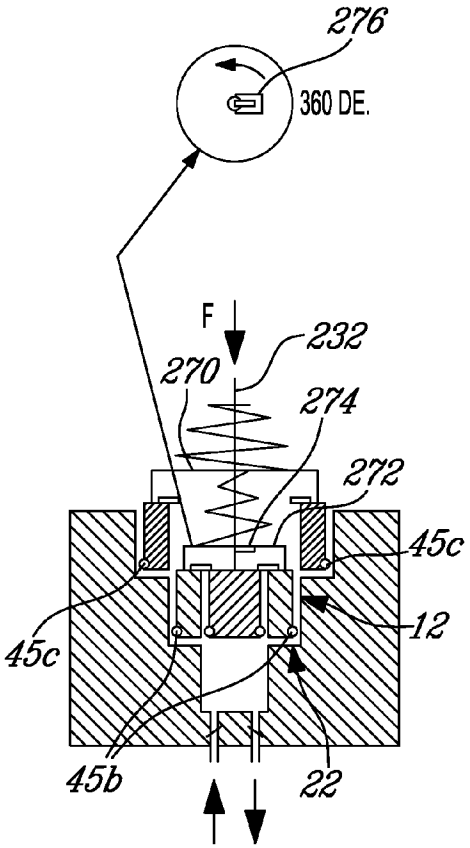

Another alternative embodiment of the attachment means 30 is shown in FIGS. 5*a*, 5*b*, 5*c* and 5*d*. In this embodiment, a force-conveying member 232 has a helical form and rotates 180 degrees over every displacement L. An upper plate 270 is located above the outer piston portion 14 and is attached thereon, and a lower plate 272 is located above the intermediate piston portion 16 and is attached thereon. The force-conveying member 232 has a locking member 274 which extends outer radially from the force-conveying member 232 and which is located near a bottom thereof. The upper plate 270, as seen in the top view of the upper plate of FIG. 5*a*, has a rectangular opening 276 therein and the lower plate 272, as seen in the top view of the lower plate 272 in FIG. 5*c*, has a rectangular opening 278 therein. In the initial position, as seen in FIG. 5*a*, the locking member 274 is aligned 180 degrees opposite to the rectangular opening 276. As the force-conveying member 232 begins moving inner piston 18 into the housing chamber 22, the locking member 274 pushes on the upper plate 270, which pushes on the lower plate 272, and so the three piston portions 14, 16, 18 displace integrally into the housing chamber 22. After the force-conveying member 232 has rotated 180 degrees and the outer piston portion 14 has reached the first annular shoulder 29, the locking member 274 is aligned with the rectangular opening 276, as seen in FIG. 5*b*, and it may pass through this opening 276, and so be free of upper plate 270. The locking member 274 may then abut the lower plate 272, and is now positioned 180 degrees opposite the rectangular opening 278 in the lower plate 272. Once the piston 12 has displaced a second distance L, and the force-conveying member 232 has rotated 360 degrees, the locking member 274 may be aligned with the rectangular opening 278, as seen in FIG. 5*c*, and the locking member 274 may then pass through opening 278, and so be free of lower plate 272. The force-conveying member 232 may then displace a third distance L, such that the inner piston 18 reaches an end of the small chamber portion 28. As seen in FIGS. 5*a* to 5*d*, seals 45*a* may be applied between inner piston portion 18 and intermediate piston portion 16 on a bottom portion of inner piston portion 18, seals 45*b* may be applied between intermediate piston portion 16 and outer piston portion 14 on a bottom portion of intermediate piston 16, and seals 45*c* may be applied between outer piston portion 14 and an inner surface of housing chamber 22 on a bottom portion of outer piston portion 14. Seals 45*a*, 45*b* and 45*c* may be used to prevent fluid leakage between each of the pistons portions 14, 16, 18 and the inner surface of the housing chamber 22.

Figure 6A:
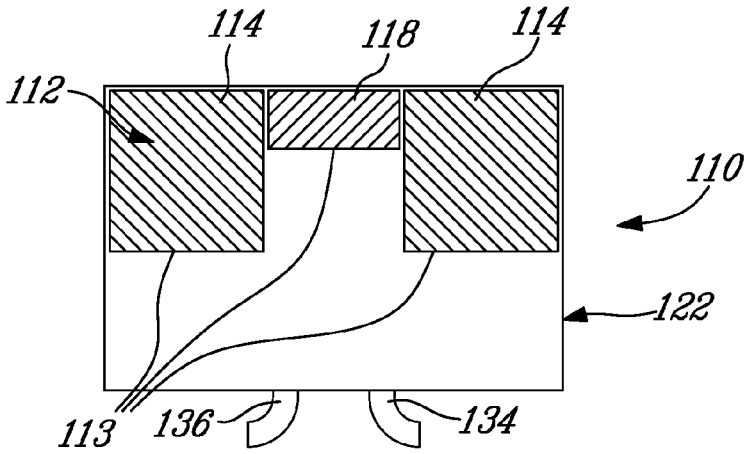
FIGS. 6*a*, 6*b* and 6*c* are schematic views illustrating three positions in the compression stroke of an alternative embodiment of the fluid compression system illustrated in FIG. 1.
Figure 6B:
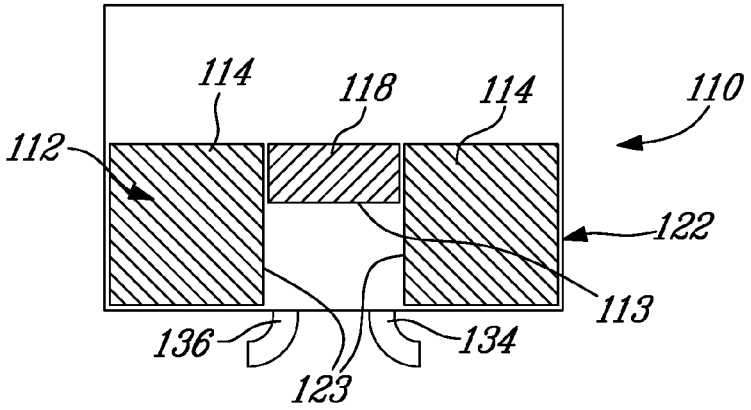
Figure 6C:
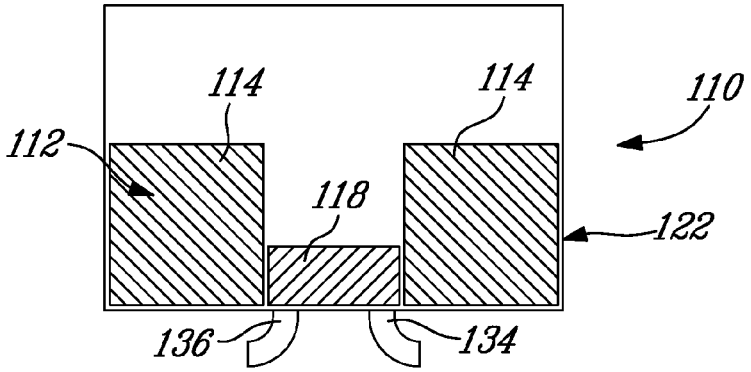

An alternative embodiment of the fluid compression system is shown in FIGS. 6*a*, 6*b* and 6*c*. In this embodiment, the fluid compression system 110 comprises a housing chamber 122 defining a fluid volume, and a piston 112. The fluid volume is enclosed by the piston 112 and the housing chamber 122. The piston 112 has an outer annular piston portion 114 which circumscribes an inner piston portion 118, and which has a longitudinal length greater than that of the inner piston portion 118. The piston portions 114, 118 are held releasably integral through the use of attachment means (not shown). The bottom surface of the piston 112 defines a compression surface 113 having a variably-sized surface area. As shown in FIG. 6*a*, the piston portions 114, 118 are initially maintained integral by the attachment means and the compression surface 113 is defined by the bottom surfaces of the piston portions 114, 118. A force is applied on the piston portion 118 and the piston 112 translates in a longitudinal direction until it reaches the position shown in FIG. 6*b*. As the outer piston portion 114 arrives to the end of the housing chamber 122, the piston portions 114, 118 remain integral until the outer piston portion 114 abuts the end of the housing chamber 122. At this moment, the attachment means release the inner piston portion 118 from the outer piston portion 114 and the inner piston portion 118 is free to further translate in housing chamber 122. As seen in FIG. 6*b*, the compression surface 113 is now defined by the bottom of the inner piston portion 118 and the radial walls 123 of the outer piston portion 114 now form part of the enclosure for the fluid volume. The inner piston portion 118 further translates into the housing chamber 122, thereby further compressing the fluid volume therein, until the inner piston portion 118 reaches an end of the housing chamber 122. The compressed fluid volume is then exhausted through the compressed fluid exhaust 134. It is to be noted that the compressed fluid volume may begin to be exhausted prior to the inner piston portion 118 reaching an end of the housing chamber 122. In another embodiment, it is not necessary for the inner piston portion 118 to fully reach an end of the housing chamber 122. The fluid compression system 110, similarly to the fluid compression system 10, still makes use of a compression surface having a variably-sized surface area, in order to achieve a higher compression ratio in a relatively shorter span of time and a relatively shorter length of the housing chamber 122, when compared to a typical piston and cylinder system.

Figure 7A:
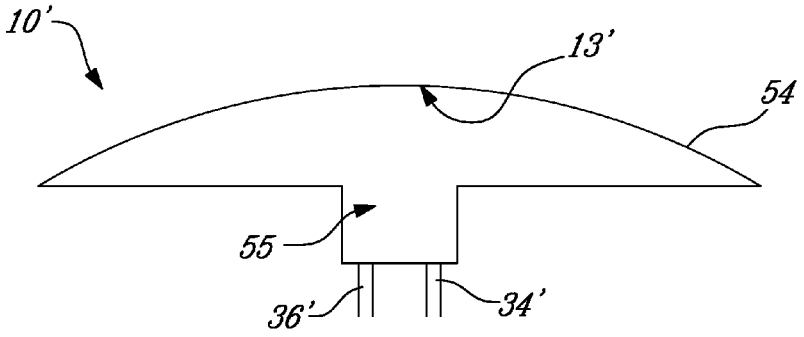
FIGS. 7*a*, 7*b* and 7*c* are schematic views illustrating three positions in the compression stroke of an embodiment of a bladder-type fluid compression system.
Figure 7B:
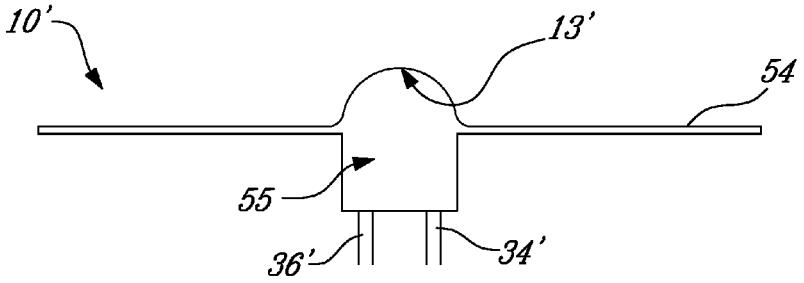
Figure 7C:
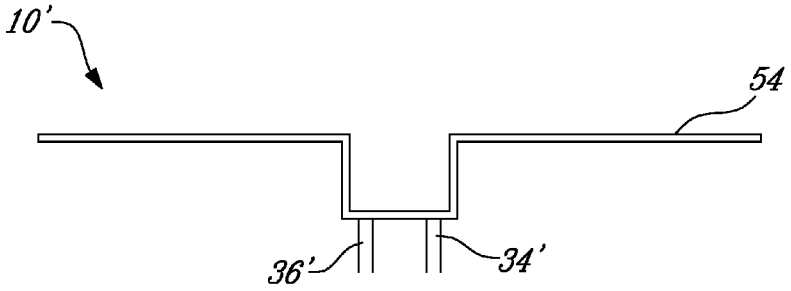
Figure 8A:
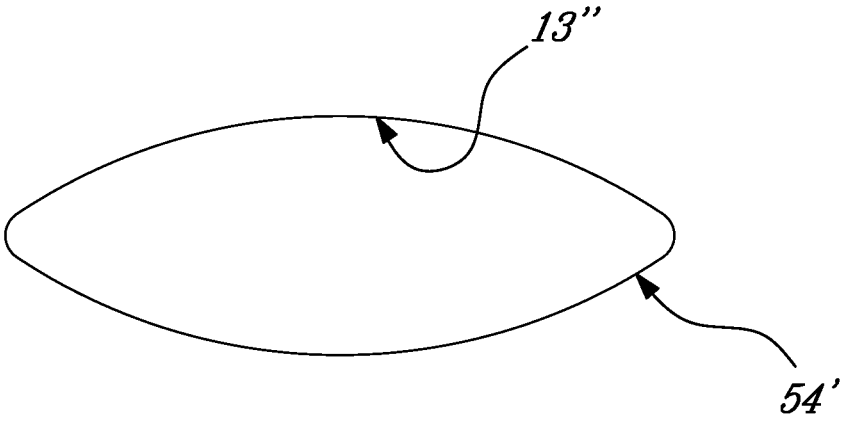
FIGS. 8*a*, 8*b* and 8*c* are schematic views illustrating three positions in the compression stroke of an alternative embodiment of the bladder-type fluid compression system shown in FIGS. 7*a*, 7*b* and 7*c*.
Figure 8B:
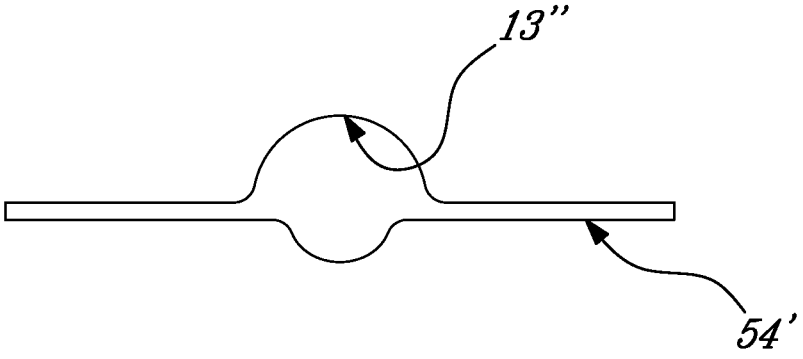
Figure 8C:
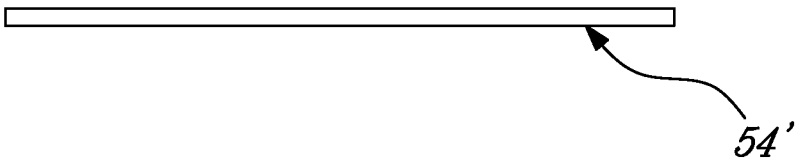

Although the fluid compression system has hereto been described as being a compression system with discrete steps or distinct stages, in an alternative embodiment, the fluid compression system 10 may comprise a piston having an effective compression surface which varies continuously along the compression stroke of the piston. For instance, the piston could take the form of a deformable membrane or bladder. The compression cycle of one embodiment of this bladder-type fluid compression system is shown in FIGS. 7*a*, 7*b*, and 7*c*. As seen in FIG. 7*a*, the fluid compression system 10' may comprise a flexible membrane 54, which acts as a piston, and which defines a compression surface 13' having a variably-sized surface area. The flexible membrane 54 may form an enclosure such as to have a fluid volume located therein. A force is applied on the flexible membrane, and the flexible membrane is deformed so as to compress the fluid volume located therein. The flexible membrane 54 may undergo continuous deformation, and as such, the surface area of the compression surface 13' may progressively decrease as the fluid volume in a flexible membrane 54 is compressed. Eventually, the compressed fluid volume may be isolated in a particular section 55 of the flexible membrane 54, as seen in FIG. 7*b*. When the fluid volume inside the flexible membrane 54 has been substantially compressed, as is shown in FIG. 7*c*, the compressed fluid is exhausted through the compressed fluid exhaust 34'. Subsequently, new fluid may then be introduced to the flexible membrane 54 through the fluid intake 36' and the flexible membrane may recover its initial configuration, such that the compression cycle may begin anew. This particular embodiment of the fluid compression system may involve continuous compression of the fluid volume, and as such, the fluid compression system encompasses more than a compression cycle having clear distinct stages. The compression cycle of another embodiment of this bladder-type fluid compression system is shown in FIGS. 8*a*, 8*b* and 8*b*. As can be seen in FIGS. 8*a*, 8*b* and 8*c*, the compression surface 13" and the shape of the flexible membrane 54' may deform in a pre-determined manner, and as such, as opposed to the embodiment shown in FIGS. 7*a*, 7*b* and 7*c*, no particular section is required to isolate the fluid volume.

Figure 10A:
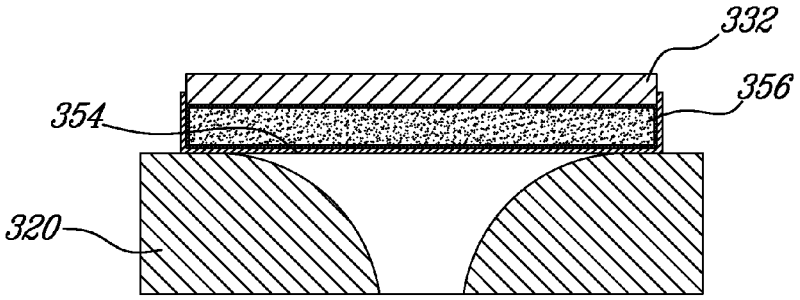
FIGS. 10*a* and 10*b* are schematic views illustrating two positions in the compression stroke of a further alternative embodiment of the bladder-type fluid compression system.
Figure 10B:
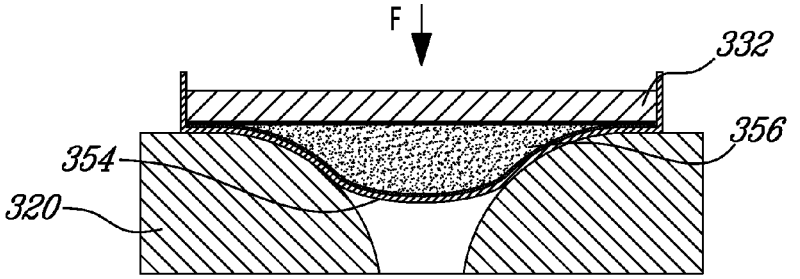

As shown in FIGS. 10*a* and 10*b*, a fluid bladder 356 can be interposed between the force transmitting member 332 and the flexible membrane 354 which is used to impart a pressure to the fluid contained in the housing 320. As can be appreciated from FIGS. 10*a* and 10*b*, the fluid bladder 356 allows applying a variable pressure on the flexible membrane 354 when a compression force or load is transmitted to the force transmitting member 332. The cross-sectional area of the chamber defined by the housing 320 gradually decreases together with the effective surface area of the membrane 354 as the same is pressed down against the inner wall of the housing chamber during the compression stroke of the device.

Because it is possible to use the fluid compression system in order to attain high compression ratios while requiring a relatively short housing chamber length and because of its ability to be used with a constant force, the fluid compression system may be used in a large number of applications. For instance in one embodiment, the compressed fluid volume in the accumulation tank may be used as an energy source, such as to power a turbine in an electricity generator and in so doing, generate electricity. In another embodiment, the compressed fluid volume may be air and the compressed air in the accumulation tank may be used as a source of compressed air in any pressurized air-based system, such as a pressurized air gun for example. In another embodiment, the compressed fluid volume may be water and the pressurized water in the accumulation tank may be used as a source of pressurized water in any pressurized water-based system, such as high pressure water cleaner. The fluid compression system may be used to compress many types of fluids, such as gases, i.e. air, or liquids, compressible or incompressible, such as water.

Many machines or mechanisms contain some form of energy loss. Energy loss may arise from heat loss, excess vibration or various other mechanical losses for instance. Different methods exist for recovering these energy losses, however many of these methods prove to be inefficient or impractical. For example, piezoelectric crystals may be used to create electricity from mechanical energy; however the amount of electricity produced is extremely small. In addition, even if the energy can be recovered, it may be difficult to use this energy or to store it. In one possible application of the fluid compression system, the fluid compression system may be used in order to recuperate energy losses.

Figure 11:
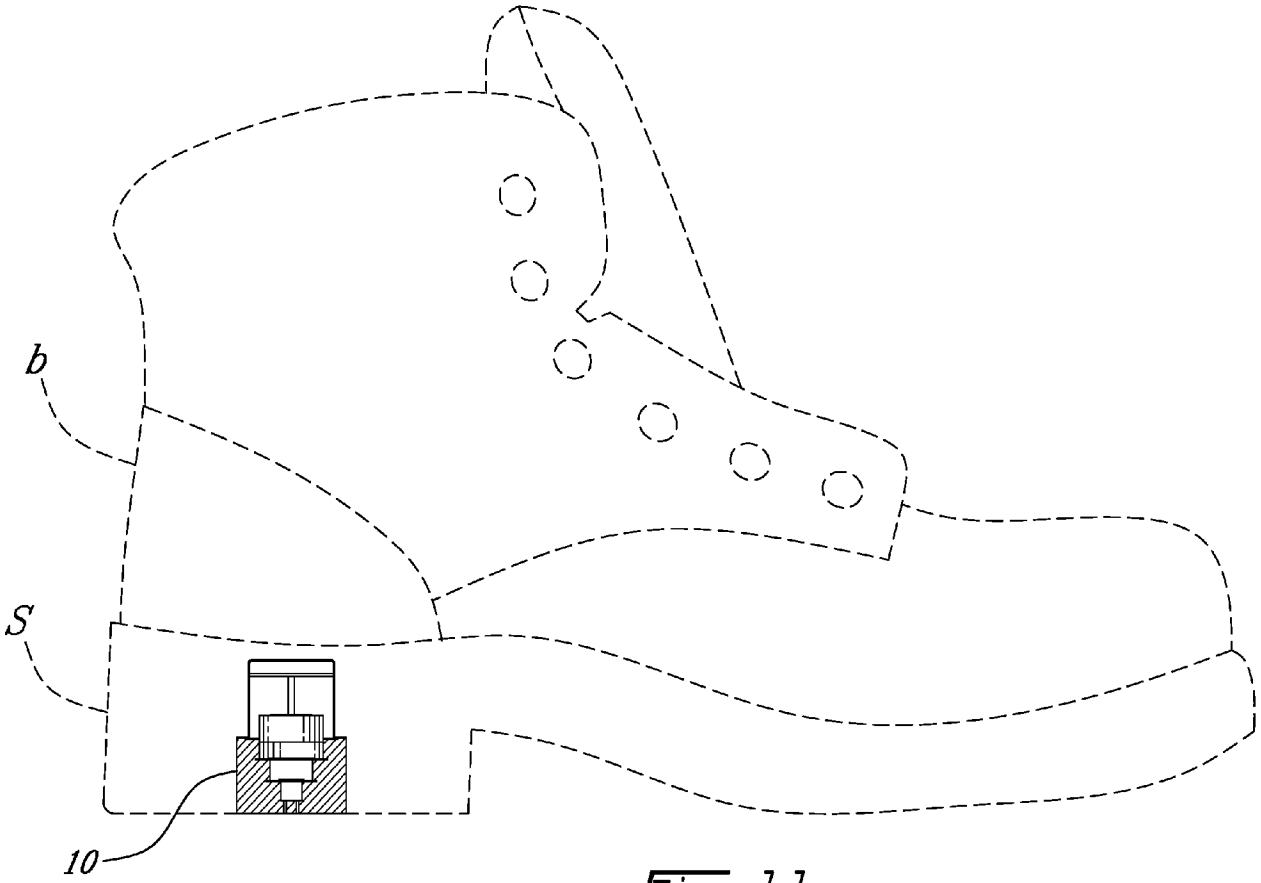
FIG. 11 is a schematic view illustrating a fluid pump integrated in a sole of a footwear, such as a boot.

In one embodiment shown in FIG. 11, the fluid compression system 10 is used in the sole S of a shoe or boot B which can be worn by a person. Every time a person presses down on the shoe, a force is applied on the force-conveying member 32 and the fluid compression system 10 compresses the fluid volume located therein. This allows for a large amount of compression to occur in a short span of time, i.e. whenever a person who is walking takes a step. This fluid volume may then be used to power a turbine and generate electricity. This electricity may then be used to power an electronics device, such as a cellphone, a radio, a global positioning system device, a portable music player or various other consumer electronics product. Furthermore, if the fluid volume being compressed is air, the temperature of the air may rise as the air is compressed. The compressed hot air may then be used in order to heat the shoe or boot, for example by expelling the hot air throughout the sole of the shoe. The compressed air may also be used to cool the sole or boot by releasing the compressed air at a relatively high velocity, such as in a fan. The compressed air may also be used in a heat exchanger system, in order to provide additional cooling or heating of the shoe or boot.

Figure 9:
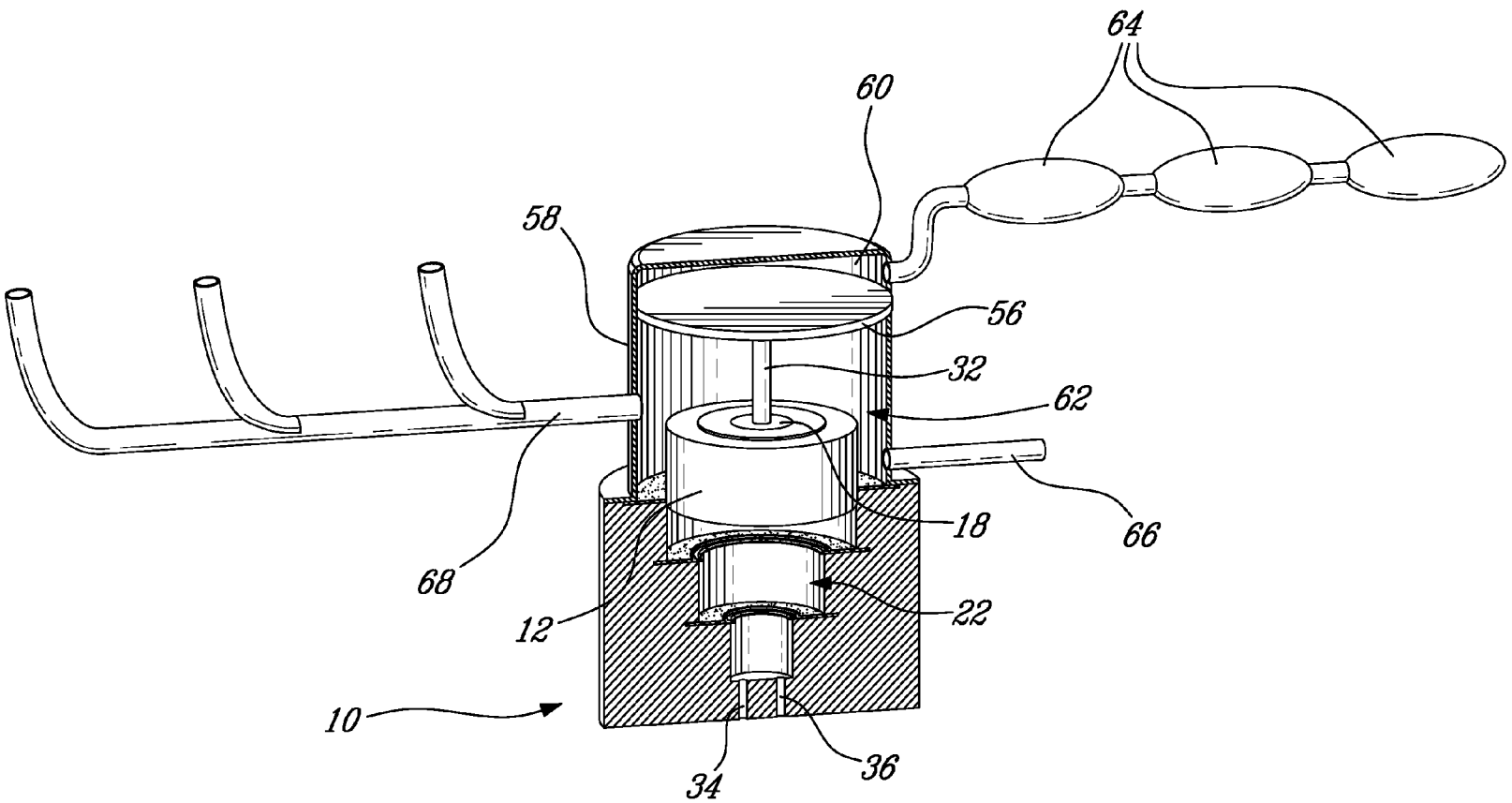
FIG. 9 illustrates one possible application in which the fluid compression system can be used for retrieving mechanical energy and converting it into fluid energy.

A specific embodiment of the fluid compression system 10, as used in a shoe or boot of a person is shown in FIG. 9. In this embodiment, the force-conveying member 32 is surmounted by a piston or top plate 56, which is located inside a cylinder 58 and which has a diameter substantially equal to the diameter of the cylinder 58. This top plate 56 divides the cylinder 58 into an upper portion 60 and a lower portion 62 thereof. The upper portion 60 of the cylinder 58 is connected to air pockets 64 or air cushions, located in the sole of the shoe or boot. This lower portion 62 of the cylinder is connected to an air intake 66 located in the sole of the shoe, and to an air exhaust 68 located in the sole of the shoe. When a person presses down on the shoe or boot, the air pockets 64 will be compressed and air located therein will be evacuated towards the upper portion 60 of the cylinder 58. This air will create a downwards pressure on the top plate 56, which will translate the force-conveying member 32 downwards and will exert a force on the inner piston portion 18. Simultaneously to this translation, the air located in the lower portion 62 of the cylinder 58 will be evacuated from the cylinder 58 through the air exhaust 68. The piston 12 will then compress the air located inside the housing chamber 22, and the compressed air will subsequently be exhausted through the compressed fluid exhaust 34. Once the compression stroke has ended and a compressive force is no longer applied on the air pockets 64, i.e. the person lifts his foot off from the ground, the return cycle begins. Fresh air is introduced to the housing chamber 22 through the fluid intake 36, air will be introduced into the lower portion 62 of the cylinder 58 from the air intake 66, air will leave the upper portion 60 of the cylinder 58 and thereby inflate the air pockets 64, the top plate 56 will translate upwards and the piston 12 will return to its initial position, as seen in FIG. 9. In another embodiment, the initial position of the piston 12 may differ. In other embodiments, the fluid compression system 10 may be used in a different configuration with a shoe or a boot.

According to a further application, the fluid compression system 10 may be used in any vibratory environment having sufficient motion to compress the fluid volume therein. Many structures experience a visible amount of vibration due to mechanical stresses or motions, for example bridges may vibrate due to cars or buildings may vibrate due to wind motion. By installing the fluid compression system in a bridge or building, it may be possible to harness the motion of this bridge or building using the fluid compression system, and thereby provide an accumulation of compressed fluid. This compressed fluid may then be used with a turbine, in order to provide electricity. This electricity may then be used to power road lights, street signs or a number of other electric devices. The fluid compression system may therefore be used as a device which converts mechanical energy to electrical energy.

According to a still further application, the fluid compression system may also be used as a bicycle tire pump or as a pump for inflatable objects, such as an inflatable mattress, an inflatable toy or additionally as a pump for sporting goods, such as a football, soccer ball, basketball etc. Pumping these elements with the present fluid compression system may be done quicker than with a traditional manual pump, as it is now possible to attain high compression ratios while using a shorter cylinder length. Because the force exerted on the fluid compression system may always be applied on the inner piston portion and therefore to the compression surface, any force applied on the fluid compression system will serve to compress the fluid volume located inside the housing chamber. The fluid compression system may therefore also be used as a device which converts mechanical energy to fluid energy, or which provides pressurized fluid using mechanical energy.

As in the examples of a person walking or a bridge vibrating, there are many instances where mechanical energy losses occur. It would be advantageous to recover these energy losses in order to provide for greater energy efficiency. In various embodiments of the present application, the fluid compression system may be used to recover such energy losses. In one embodiment, these recovered energy losses may be stored in the form of an accumulation of compressed fluid, or in another embodiment, they may be used to power an electricity-generating turbine.

What is claimed is:

1. A fluid pump comprising a chamber containing a fluid, the chamber having a fluid inlet and a fluid outlet, a compression member having a compression surface with an effective surface area movable against fluid pressure in the chamber, the compression member having a compression stroke and a return stroke, the effective surface area of the compression member decreasing in size together with a corresponding cross-sectional area of the chamber from a maximal area at a beginning of the compression stroke to a minimal area at the end of the compression stroke, compression member having a piston mounted for linear reciprocable movement in the chamber, the piston comprising at least first and second concentric piston portions which are releasably interconnected to one another; when the at least first and second concentric piston portions are interconnected for joint movement, the effective surface area of the piston being equal to the combined surface areas of the first and second concentric piston portions; when the second piston portions is released from the first piston portion, thereby allowing the first piston portion to continue its stroke, the effective surface area of the piston being equal to the surface area of the first piston portion alone, wherein a releasable connector is provided between said at least first and second concentric piston portions, said releasable connector comprising a biasing member mounted to one of said first and second concentric piston portions and urging a locking member in engagement with both the first and second concentric piston portions, wherein said locking member comprises a locking ball trapped in opposed facing depressions defined in adjacent surfaces of the first and second piston portions, and wherein the second piston portion is engageable in an axially abutting relationship at one point during the compression stroke with an inner shoulder provided on an inner wall of the chamber, the engagement of the second piston portion with the inner shoulder preventing further axial advancement of the second piston portion in the chamber, and wherein a shear force resulting from the continued advancement of the first piston portion after the second piston portion has axially abutted against the inner shoulder causes a biasing force of the biasing member to be overcome, thereby allowing the locking ball to move further into one of said opposed facing depressions and out of engagement from the other one of the depressions to effect disconnection of said first and second piston portions.

2. The pump defined in claim 1, wherein the effective surface area of the compression member and the cross-sectional area of the chamber continuously decreases from the maximal area to the minimal area as the compression member travels towards the end of the compression stroke thereof.

3. The pump defined in claim 1, wherein the effective surface area of the compression member and the cross-sectional area of the chamber both change in a step-fashion at at least one discrete location along the compression and return strokes.

4. The pump defined in claim 1, wherein the chamber comprises at least first and second axially serially interconnected chamber portions, the first chamber portion having a first cross-sectional area, the second chamber portion having a second cross-sectional area, the second cross-sectional area being smaller than the first cross-sectional area, the first cross-sectional area generally corresponding to the combined surface area of the first and second piston portions, whereas the second cross-sectional area generally corresponding to the surface area of the first piston portion.

5. The pump defined in claim 1, wherein the biasing member comprises a pin slidably radially disposed inside the second piston portion, and an outer ball disposed at an outermost end of the pin; the outer ball normally riding on the inner wall of the chamber to prevent the pin and the locking ball from being pushed radially outwardly; the opposed facing depressions comprising a first depression defined in an outer radial surface of the first piston portion, the first piston portion being positioned radially inwardly of the second piston portion and adjacent thereof, and a second depression defined in the inner wall of the chamber for receiving the outer ball when the second piston portion axially abuts against the inner shoulder; the locking ball being located at an innermost end of the pin, the locking ball protruding radially inwardly from the second piston portion and into the first depression of the first piston portion when the first and second piston portions are interconnected and are moving together, the locking ball being pushed radially out from the first depression of the first piston portion and into the second piston portion as a result of the continued advancement of the first piston portion when the second piston portion axially abuts the inner shoulder in the chamber, the continued advancement of the first piston position causing the locking ball to push on the pin which, in turn, pushes the outer ball radially outwardly into the second depression, thereby freeing the first piston portion from the second piston portion.

6. The pump defined in claim 1, wherein the second piston portion is an outer annular piston portion and the first piston portion is an inner piston portion sized so as to fit in the outer annular piston portion, wherein a piston rod extends from the inner piston portion, and wherein the releasable connector is provided between the inner and outer piston portions for selectively allowing a force to be indirectly transmitted from the piston rod to the outer annular piston portion via the inner piston portion.

7. The pump of claim 1, wherein the compression member comprises at least three concentric pistons disposed radially one inside the other, the at least three concentric pistons including a hollow intermediately-sized piston circumscribing in abutment an inner radial piston and a hollow outer radial piston circumscribing in abutment the intermediately-sized piston; securing means being provided between the at least three concentric pistons for selectively allowing joint movement thereof; a force-conveying member connected to the inner radial piston; and wherein the chamber has at least three cylinders consecutively longitudinally spaced one from the other, with a first cylinder having a first inner diameter substantially similar to an outer diameter of the outer radial piston, a second cylinder spaced longitudinally from the first cylinder and having a second inner diameter substantially similar to an outer diameter of the intermediately-sized piston, and a third cylinder spaced longitudinally from the second cylinder and having a third inner diameter substantially similar to an outer diameter of the inner radial piston, the outlet of the chamber extending from the third cylinder for allowing fluid passage therethrough, the first cylinder receiving the three pistons until the outer radial piston abuts an end wall of the first cylinder and the securing means releases the intermediately-sized piston from the outer radial piston, the second cylinder receiving the intermediately-sized piston and the inner radial piston until the intermediately-sized piston abuts an end wall of the second cylinder and the securing means releases the inner radial piston from the intermediately-sized piston, and the third cylinder receiving the inner radial piston; the fluid in the chamber being compressed by the displacement of the pistons in the first, second and third cylinders, the fluid flowing through the outlet as the inner radial piston is received in the third cylinder.

8. A footwear having a pump as defined in claim 1 integrated therein for compressing a fluid volume each time a wearer press down on the footwear.

9. The footwear defined in claim 8, wherein the fluid pump is integrated in a sole of the footwear for feeding a turbine which is operatively connected to a generator for generating electricity as the wearer is walking 10. The footwear defined in claim 8, wherein the footwear has an upper extending from a sole for receiving the wearer's foot, wherein the fluid volume is air, and wherein the air compressed by the pump is expelled through the sole and the upper of the footwear.

11. The footwear defined in claim 8, wherein the compression member of the fluid pump is driven by a force transmitting member comprising a reciprocating piston sliding in a cylinder, the piston dividing the cylinder into first and second chambers, the first chamber being connected to at least one air cushion located in a sole of the footwear, the second chamber being connected to an air intake and to an air exhaust, whereby when the wearer presses down on the footwear, the air in the at least one air cushion is expelled from the air cushion into the first chamber to displace the piston which, in turn, impart motion to the compression member of the fluid pump.

12. A footwear having a fluid pump integrated therein for compressing a fluid volume each time a wearer press down on the footwear, the fluid pump comprising a chamber containing a fluid, the chamber having a fluid inlet and a fluid outlet, a compression member having a compression surface with an effective surface area movable against fluid pressure in the chamber, the compression member having a compression stroke and a return stroke, the effective surface area of the compression member decreasing in size together with a corresponding cross-sectional area of the chamber from a maximal area at a beginning of the compression stroke to a minimal area at the end of the compression stroke, wherein the compression member of the fluid pump is driven by a force transmitting member comprising a reciprocating piston sliding in a cylinder, the piston dividing the cylinder into first and second chambers, the first chamber being connected to at least one air cushion located in a sole of the footwear, the second chamber being connected to an air intake and to an air exhaust, whereby when the wearer presses down on the footwear, the air in the at least one air cushion is expelled from the air cushion into the first chamber to displace the piston which, in turn, impart motion to the compression member of the fluid pump.

* * * * *